US008209058B2

(12) United States Patent
Kawaai et al.

(10) Patent No.: US 8,209,058 B2
(45) Date of Patent: Jun. 26, 2012

(54) CONTROLLER FOR COOLING SYSTEM

(75) Inventors: Tsuyoshi Kawaai, Uji (JP); Masaru Koshiba, Kumagaya (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 339 days.

(21) Appl. No.: 12/564,409

(22) Filed: Sep. 22, 2009

(65) Prior Publication Data

US 2010/0076603 A1 Mar. 25, 2010

(30) Foreign Application Priority Data

Sep. 25, 2008 (JP) ..... 2008-245232

(51) Int. Cl.

| | |
|---|---|
| ***G01M 1/38*** | (2006.01) |
| ***G05D 3/12*** | (2006.01) |
| ***G05D 23/32*** | (2006.01) |
| ***G06F 7/00*** | (2006.01) |
| ***G06F 11/30*** | (2006.01) |
| ***G01K 13/00*** | (2006.01) |
| ***F25B 49/00*** | (2006.01) |

(52) U.S. Cl. ..... 700/276; 700/291; 707/705; 702/182; 62/129; 62/132; 62/157

(58) Field of Classification Search ..... 66/129, 66/132, 157; 702/182–184; 700/276, 291; 707/705; 62/129, 132, 157
See application file for complete search history.

(56) References Cited

U.S. PATENT DOCUMENTS

| | | | | |
|---|---|---|---|---|
| 2002/0147823 | A1* | 10/2002 | Healy | 709/230 |
| 2002/0163431 | A1* | 11/2002 | Nakajima et al. | 340/540 |
| 2004/0186628 | A1* | 9/2004 | Nakajima et al. | 700/291 |
| 2005/0040250 | A1* | 2/2005 | Wruck | 236/51 |
| 2005/0276389 | A1* | 12/2005 | Hinkson et al. | 379/37 |
| 2010/0229583 | A1* | 9/2010 | Komori et al. | 62/238.7 |

FOREIGN PATENT DOCUMENTS

| | | | |
|---|---|---|---|
| JP | 9-217974 | A | 8/1997 |
| JP | 2003329351 | A * | 11/2003 |
| JP | 2004-57347 | A | 2/2004 |

* cited by examiner

*Primary Examiner* — Albert Decady
*Assistant Examiner* — Darrin Dunn
(74) *Attorney, Agent, or Firm* — Westerman, Hattori, Daniels & Adrian, LLP

(57) ABSTRACT

According to a controller for a cooling system, when an optimum value of a low-pressure side pressure set value corresponding to an operation environmental condition to be generated is registered in a data base 15, the optimum value of the low-pressure side pressure set value is used. In a case where the optimum value of the low-pressure side pressure set value is not registered in the data base 15, when an optimum value of a low-pressure side pressure set value Ps corresponding to an operation environmental condition adjacent to the operation environmental condition to be generated is registered, the optimum value of the low-pressure side pressure set value Ps is used.

5 Claims, 5 Drawing Sheets

CONTROLLER FOR COOLING SYSTEM

INCORPORATION BY REFERENCE

The present application claims priority under 35 U.S.C. §119 to Japanese Patent Application No. 2008-245232 filed on Sep. 25, 2008. The content of the application is incorporated herein by reference in its entirety.

BACKGROUND OF THE INVENTION

1. Field of the Invention

The present invention relates to a controller for a cooling system comprising a low-temperature showcase set in a supermarket or the like, and a refrigerating machine for supplying refrigerant to the low-temperature showcase, for example.

2. Description of the Related Art

It has been general that a plural of low-temperature showcases such as freezing/refrigerating showcases or the like are installed in a store such as a supermarkets or the like and they are supplied to display and sold foods while freezing/refrigerating these foods. From the viewpoint of attempts to environmental problems and reduction of energy cost, it has been also recently recognized as an important matter in stores such as supermarkets, etc. to take countermeasures to reduce power consumption of a cooling system having low-temperature showcases. In order to reduce the power consumption, it is important to enhance the operation efficiency of the low-temperature showcases and the refrigerating machine themselves, however, it is also possible to reduce power consumption in consideration of the cooperation of the respective parts constituting the cooling system containing the low-temperature showcases and the refrigerating machine.

Therefore, there has been proposed a technique of targeting an invert type refrigerating machine, setting a low-pressure side pressure value of the refrigerating machine and setting an inverter frequency on the basis of the low-pressure side pressure value to reduce the power consumption (for example, JP-A-Hei-9-217974).

In general, when the low-pressure side pressure of the refrigerating machine is set to a low value, the cooling power of the refrigerating machine is high, and thus the cooling temperature of the low-temperature showcase decreases, so that the cooling state (cooling condition) is kept excellent. Conversely, when the low-pressure side pressure is set to a high value, the cooling power of the refrigerating machine is lowered, however, the power consumption is reduced. That is, in the control of the refrigerating machine based on the setting of the low-pressure side pressure, the energy saving operation and the excellent cooling state have conflicting relation to each other, and it has been hitherto general that the excellent cooling state has priority over the energy saving operation and thus the low-pressure side pressure is set to a low value.

The required cooling power of the refrigerating machine is changed in accordance with the operation environmental condition such as the load state of the low-temperature showcase or the like. Therefore, there has been recently proposed a technique of automatically the low-pressure side pressure value in accordance with the operation environmental condition, thereby satisfying both the securement of the excellent cooling state and the energy saving operation. This technique has a data base for storing a set value of optimum low-pressure side pressure (hereinafter referred to as "low-pressure side pressure set value") every operation environmental condition. According to this technique, the operation is executed for a while under some operation environmental condition, and the optimum low-pressure side pressure set value is learned under the operation environmental condition concerned. when the operation environmental condition concerned comes afterwards, the low-pressure side pressure is quickly set to the set value of the optimum low-pressure side pressure (see JP-A-2004-57347, for example).

The operation environmental condition contains parameters such as a time zone, air temperature, etc. For example, even in the same time zone, the temperature is greatly varied in accordance with the difference in season, day or the like. Therefore, there is a case where it takes several days or more to learn the set value of the optimum low-pressure side pressure for some operation environmental condition.

Furthermore, at the start time of the operation, the set value of the optimum low-pressure side pressure under the operation environmental condition at that time has not yet been registered and thus it is under unlearned state. In the case of the operation under an unlearned operation environmental condition, the operation is executed with a low-pressure side pressure set value with which no energy saving effect is obtained until the learning is completed. However, as descried above, it takes relative long time to complete the learning for some operation environmental condition, and thus the period for which the energy saving is not obtained is increased.

SUMMARY OF THE INVENTION

The present invention has been implemented in view of the foregoing situation, and has an object to provide a controller for a cooling system that enables an operation optimum to an operation environmental condition even when the operation environmental condition is unlearned.

In order to attain the above object, according to the present invention, a controller for a cooling system comprising a low-temperature showcase having a storage room and a refrigerating machine for supplying refrigerant to the low-temperature showcase, comprises: a control data generating unit for generating control data for controlling an operation of the refrigerating machine under an operation environmental condition for defining an operation environment of the cooling system; and a data base constructing unit for registering an optimum value of the control data based on a "good" or "bad" determination result concerning the cooling state of the storage room of the low-temperature showcase which occurs through the operation based on the control data while associating the optimum value with the operation environmental condition, thereby constructing a data base, wherein when an optimum value of the control data corresponding to an operation environmental condition to be generated is registered in the data base, the control data generating unit uses the optimum value of the control data, and when an optimum value of the control data corresponding to an operation environmental condition to be generated is not registered in the data base, the control data generating unit uses an optimum value of the control data registered in association with an operation environmental condition adjacent to the operation environmental condition to be generated.

In the above controller for the cooling system, the operation environmental condition may contain at least in-store temperature, out-of-store temperature and time, and the control data generating unit may use, as the adjacent operation environmental condition, an operation environmental condition whose in-store temperature or out-of-store temperature is adjacent to that of the operation environmental condition to be generated.

In the above controller for the cooling system, when optimum values of the control data are respectively registered in an operation environmental condition whose in-store temperature is adjacent and an operation environmental condition whose out-of-store temperature is adjacent, the control data generating unit may use the optimum value of the control data for the operation environmental condition whose out-of-store temperature is adjacent.

In the above controller for cooling system, the optimum value of the control data corresponding to the operation environmental condition to be generates is not registered in the data base and the optimum value of the control data corresponding to the operation environmental condition adjacent to the operation environmental condition to be generated is not registered in the data base, the control data generating unit may use control data which is used just before the refrigerating machine is operated.

In the above controller for the cooling system, the control data generating unit may generate the control data so as to reduce power consumption of the refrigerating machine with keeping the storage room of the low-temperature showcase cooled on the basis of the cooling state and the operation environmental condition.

According to the present invention, in a case where the optimum value of the control data corresponding to the operation environmental condition to be generated is not registered in the data base, when the optimum value of the control data corresponding to the environmental condition adjacent to the operation environmental condition to be generated is registered, the optimum value of the control data corresponding to the adjacent operation environmental condition is used. Accordingly, as compared with a case where a default value of the control data is used, the operation can be executed on the basis of the control data which is nearly optimum to the operation environmental condition to be generated.

DETAILED DESCRIPTION OF THE PREFERRED EMBODIMENTS

A preferred embodiment according to the present invention will be described with reference to the accompanying drawings.

Figure 1:
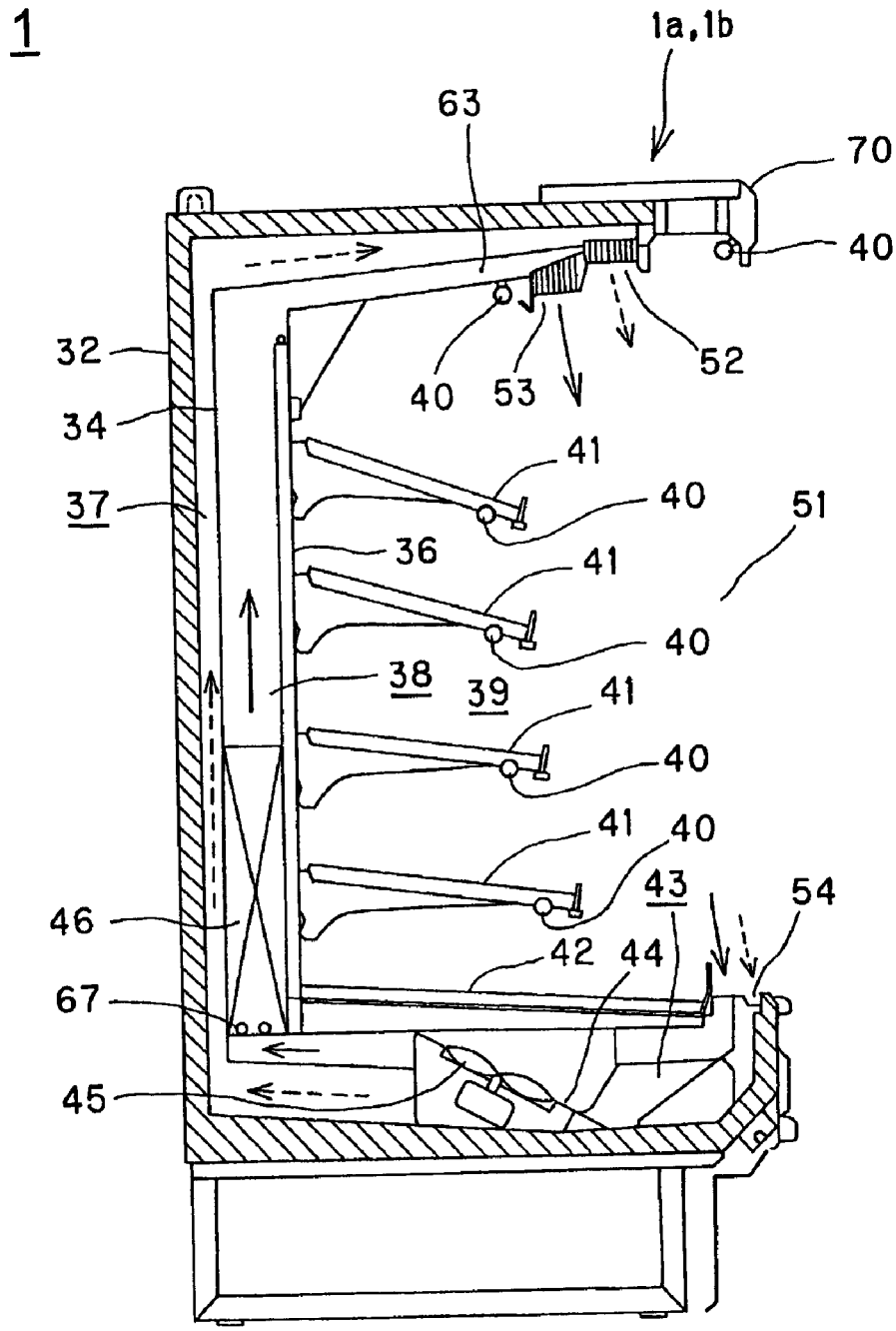
FIG. 1 is a longitudinally sectional view showing an embodiment of a low-temperature showcase constituting a cooling system to which the present invention is applied.
Figure 2:
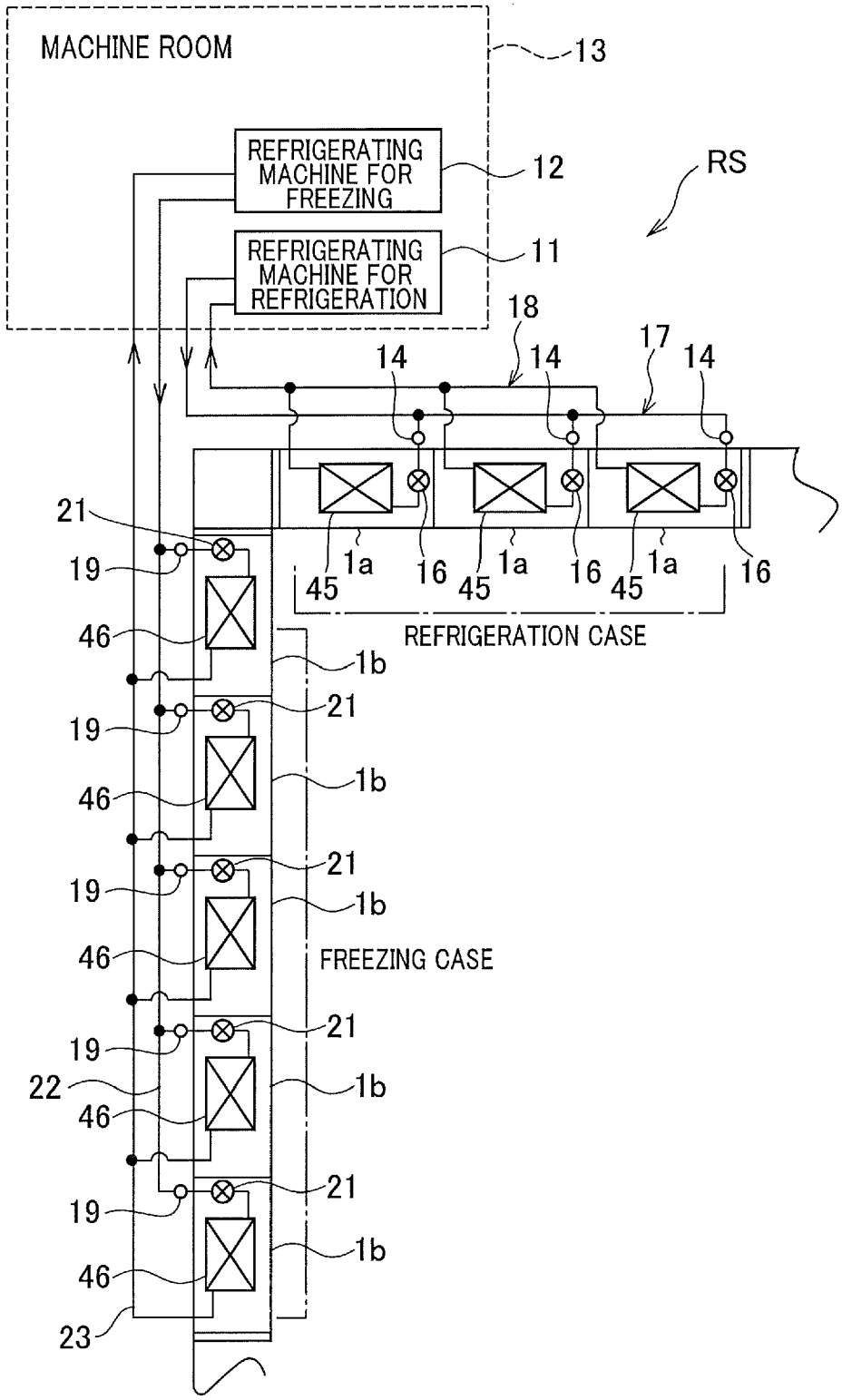
FIG. 2 is a diagram showing a piping construction of a supermarket in which the low-temperature showcase shown in FIG. 1 is installed.
Figure 3:
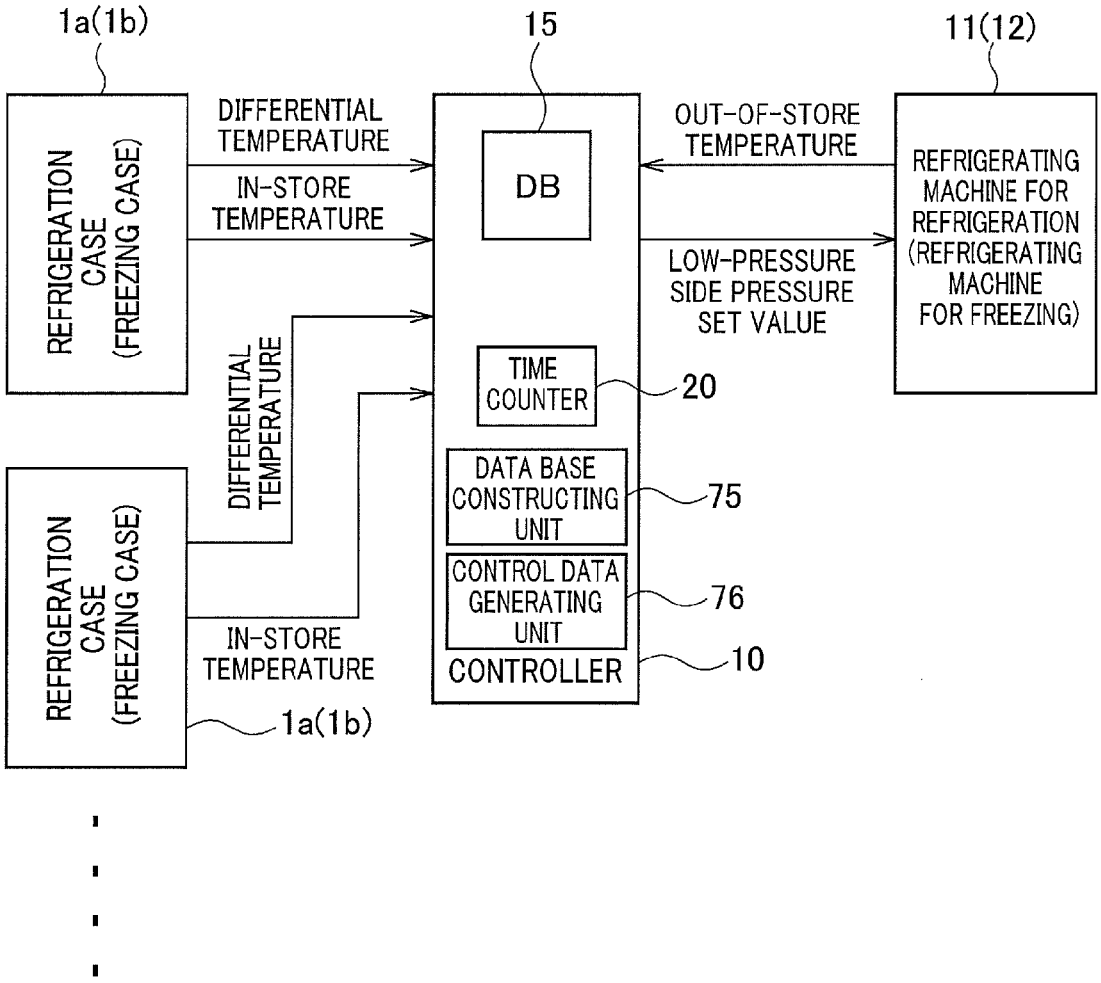
FIG. 3 is a control block diagram of the cooling system according to the present invention.

FIG. 1 is a longitudinally-sectional view of a low-temperature showcase 1 according to an embodiment, FIG. 2 is a diagram showing a piping construction of a cooling system RS for a supermarket in which a low-temperature showcase 1 is installed, and FIG. 3 is a control block diagram of the cooling system RS of the present invention.

The low-temperature showcase 1 is a vertical open showcase, and it comprises an adiabatic wall having a substantially U-shaped cross-section and side plates (not shown) which are secured to both the sides of the adiabatic wall 32 at the installation place. An outer-layer partition plate 34 and an inner-layer partition plate 36 are secured to the inside of the adiabatic wall so as to be spaced from each other. The gap between the adiabatic wall 32 and the outer-layer partition plate 34 serves as an outer-layer duct 37, and the gap between the inner-layer partition plate 36 and the outer-layer partition plate 34 serves as an inner-layer duct 38, and the inside of the inner-layer partition plate 36 serves as a storage room 39 (repository).

Plural stages of shelves 41 are installed in the storage room 39, and fluorescent lamps 40 are secured to the front portions of the lower surfaces of the respective shelves 41 and the ceiling portion of the storage room 39 and in a canopy top 70. A deck pan 42 is secured to the bottom portion of the storage room 39, and the lower side of the deck pan 42 is used as a bottom duct 43 intercommunicating with the outer-layer duct 37 and the inner-layer duct 38. A fan case 44 containing an air blower 45 is disposed in the bottom duct 43. An evaporator 46 is vertically disposed at the lower portion of the inner-layer duct 38 located at the backside of the storage room 39.

An outer-layer discharge port 52 and an inner-layer discharge port 53 are juxtaposed with each other at the front and rear sides of the upper edge of the front opening portion 51 of the storage room 39, and the outer-layer discharge port 52 intercommunicates with the outer-layer duct 37, and the inner-layer discharge port 53 intercommunicates with the inner-layer duct 38. A suction port 54 is formed at the lower edge of the front opening portion 51, and intercommunicates with the bottom duct 43.

When the air blower 45 in the fan case 44 is operated, air in the bottom duct 43 is blown out to the outer-layer duct 37 and the inner-layer duct 38 at the rear side. The air in the outer-layer duct 37 is directly blown up and then blown out from the outer-layer discharge port 52 at the upper edge of the front opening portion 51 to the suction port 54 at the lower edge of the front opening portion 51. However, the air in the inner-layer duct 38 is blown up while heat-exchanged with refrigerant in the evaporator 46 to be cooled and then blown out from the inner-layer discharge port 53 at the upper edge of the front opening portion 51 to the suction port 54 at the lower edge of the front opening portion 51.

Accordingly, an inside cooled air curtain and an outside air curtain for protecting the inside cooled air curtain are formed at the front opening portion 51 of the storage room 39. Therefore, the outside air can be prevented or suppressed from invading into the front opening portion 51, and also a part of the inside cooled air curtain is circulated in the storage room 39 to cool the inside of the storage room 39. when the store is closed, the front opening portion 51 is covered by a night cover (not shown).

The cooled air, etc. is returned from the suction port 54 to the bottom duct 43 and sucked to the air blower 45 again. Furthermore, a defrosting heater 67 is fixed to the evaporator 46, and the frosted evaporator 46 is heated by the heater 67.

In FIG. 2, reference numeral 1*a* represents a low-temperature showcase for accommodating and displaying fruit and vegetable goods (articles) (hereinafter referred to as "refrigeration (cold storage) case"), and three refrigeration cases are juxtaposed. Furthermore, reference numeral 1*b* represents a low-temperature showcase for accommodating and displaying fresh fishes (articles) (hereinafter referred to as "freezing (ice temperature) case", and five freezing cases are juxtaposed.

Each of the refrigeration cases 1*a* and the freezing cases 1*b* is installed along the wall surface in a store such as a supermarket or the like. Reference numerals 11 and 12 represent separate placement type refrigerating machine for refrigeration and refrigerating machine for freezing which are installed (separately installed) in a machine room 13 at the outside of the store. The cooling system RS of this invention is constructed by the refrigeration cases 1*a*, the freezing cases 1*b*, the refrigerating machine 11 for refrigeration (cold storage) and the refrigerating machine 12 for freezing.

Each of the refrigerating machines 11 and 12 is constructed by a compressor, a condenser, etc. (not shown). The entrance sides of the evaporators 45 of the refrigeration cases 1*a* are connected through electromagnetic valves 14 and expansion valves 16 to the liquid refrigerant pipe 17 of the refrigerating machine 11 for refrigeration in parallel to one another, and the exit sides of the evaporators 45 are connected to the liquid refrigerant pipe 18 of the refrigerating machine 11 for refrigeration in parallel to one another.

Furthermore, the entrance sides of the evaporators 46 of the freezing cases 1*b* are connected through electromagnetic valves 19 and expansion valves 21 to the liquid refrigerant pipe 22 of the refrigerating machine 12 for freezing in parallel to one another, and also the exit sides of the evaporators 46 are connected to the gas refrigerant pipe 23 of the refrigerating machine 12 for freezing in parallel to one another.

A controller for each of the refrigeration cases 1*a* and the freezing cases 1*b* controls the opening/closing operation of the electromagnetic valves 14, 19 on the basis of the temperature of the cooled air in the storage room 39 or the temperature of the cooled air blown to the storage room 39, and supplies refrigerant to the evaporators 45, 46 to cool the inside of the storage room 39. Specifically, upper limit temperature and lower limit temperature are set above and below a target temperature value (set temperature) of the storage room 39, and the controller executes ON-OFF control of the electromagnetic valve so that the electromagnetic valves 14, 19 are opened at the upper limit temperature and closed at the lower limit temperature. Accordingly, the temperature of the storage room 39 (in the store room) approaches to the target value on an average. However, a differential temperature occurs between the target value and the actual temperature of the storage room 30 in accordance with the cooling capacity or the surrounding environment.

The compressor of each of the refrigerating machines 11 and 12 is operated when some electromagnetic valve 14, 19 is opened, however, stopped when the electromagnetic valves 14 or 19 of all the refrigeration cases 1*a* or the freezing cases 1*b* are closed. In this case, specifically, the low-pressure value pressure set value of the refrigerant circuit is used, and the controller of each of the refrigerating machine 11 for refrigeration and the refrigerating machine 12 for freezing stops the compressor concerned when all the electromagnetic valves 14 or 19 are closed and thus the pressure at the low pressure side of the refrigerant circuit is reduced to the low-pressure side pressure set value. When the electromagnetic valve of any refrigeration case 1*a* or the electromagnetic valve 19 of any freezing case 1*b* is opened and thus the pressure at the low-pressure side is higher than the low-pressure side pressure set value (in this case, a predetermined hysteresis is provided), the compressor is started again.

Next, the operation of the controller 10 for reducing the power consumption of the cooling system RS according to the present invention will be described with reference to FIG. 3.

The controller 10 is equipped with a memory constructing a data base 15 described later and a general-purpose microcomputer having a time counting function (represented by reference numeral 20), and also equipped with a data base constructing unit 75 for constructing the data base and a control data generator 76 for generating and outputting control data for operation to the refrigerating machine 11 for refrigeration or the refrigerating machine 12 for freezing.

The controllers 10 are respectively interposed between each refrigeration case 1*a* and the refrigerating machine 11 for refrigeration and also between each freezing case 1*b* and the refrigerating machine 12 for freezing, and perform data communication therebetween. The controllers 10 between each refrigeration case 1*a* and the refrigerating machine 11 for refrigeration and also between each freezing case 1*b* and the refrigerating machine 12 for freezing may be constructed by one controller.

In this case, the differential temperature of the storage room 39 (repository) and the temperature in the store are input from each of the refrigeration cases 1*a* and the freezing cases 1*b* to the respective controllers 10. Furthermore, out-of-store temperature is input from each of the refrigerating machine 11 for refrigeration and the refrigerating machine 12 for freezing. The control data generators 76 of the controllers 10 set the low-pressure side pressure set values for the refrigerating machines 11 and 12 respectively, and outputs these set values as control data.

Next, the specific operation of the controller 10 will be described.

In the following description, the controller 10 interposed between the refrigerating case 1*a* and the refrigerating machine 11 for refrigeration will be described. However, the same description is applied to the controller 10 between the freezing case 1*b* and the refrigerating machine 12 for freezing.

First, the data base 15 described above is constructed in the memory of the controller 10 by the data base constructing unit 75. Data registration places are classified in the data base 15 on the basis of three conditions of in-store temperature, out-of-store temperature and time zone which serve as indexes for identifying an operation environmental condition. Accordingly, these data are registered as discrete data classified at plural stages.

The discrete rule of this case is as follows.

In-store temperature Ti (° C.): the range from 0° C. to +35° C. is classified into eight stages every 5° C. (actually, an average value per hour is adopted.

Out-of-store temperature To (° C.): the range from −5° C. to +40° C. is classified into ten stages every 5° C. (actually, an average value per hour is adopted).

Time zone t: the time is classified into 24 stages every hour. That is, totally, 1920 registration places are constructed.

The in-store temperature and the out-of-store temperature are operation environmental conditions affected by the natural environment. Furthermore, the cooling state of the refrigeration case 1*a* is affected not only by the natural environment, but also by the frequency of taking in and out foods by shop clerks or customers, turn-off of illumination for the purpose of energy saving when the store is closed, closing of showcases by night covers, etc., however, such a situation can be identified in accordance with the time zone. When the in-store temperature is lower than 0° C., it is handled as 0° C., and when the in-store temperature is higher than +35° C., it is handled as +35° C. When the out-of-store temperature is lower than −5° C., it is handled as −5° C., and when the out-of-store temperature is higher than +40°, it is handled as +40°.

Figure 4:
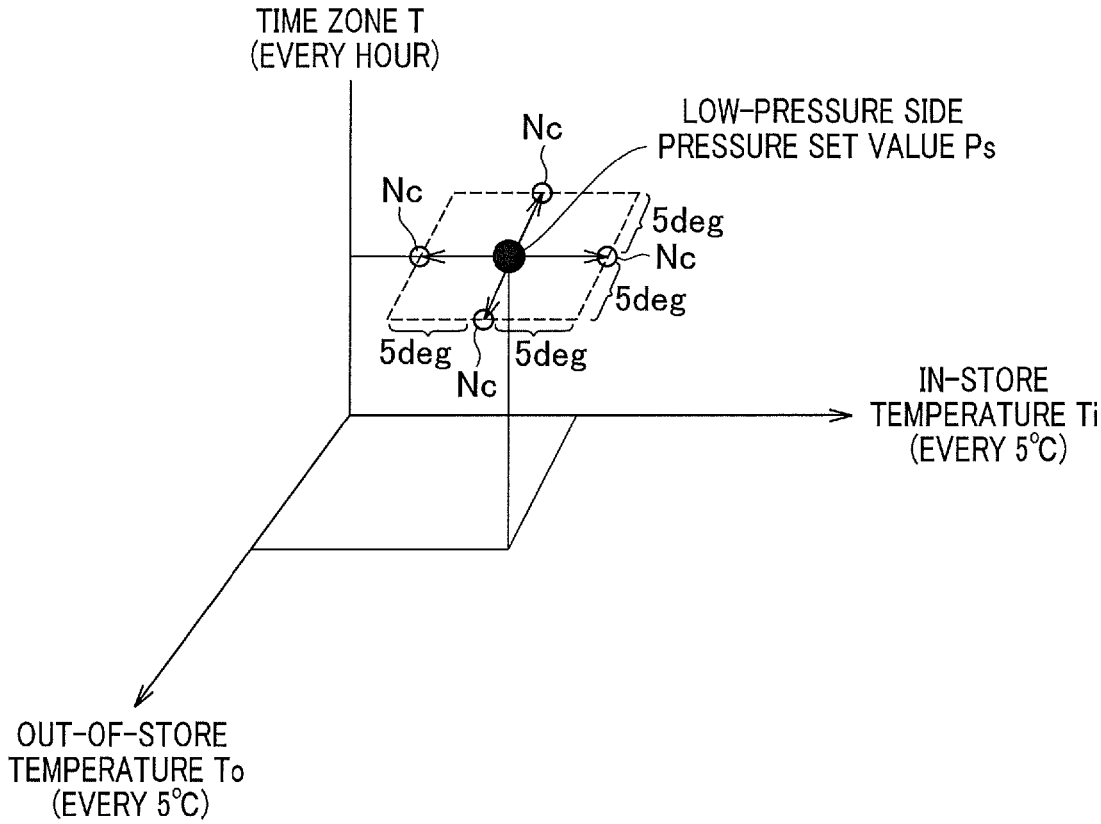
FIG. 4 is a diagram showing a data base of a controller for the cooling system of the present invention.

The data base constructing unit 75 of the controller 10 registers the low-pressure side pressure set value Ps (PaG) of the refrigerating machine 11 for refrigeration as the optimum value of the control data in each registration place of the data base 15 as shown in FIG. 4.

In the above construction, an embodiment of the actual control will be described.

Figure 5:
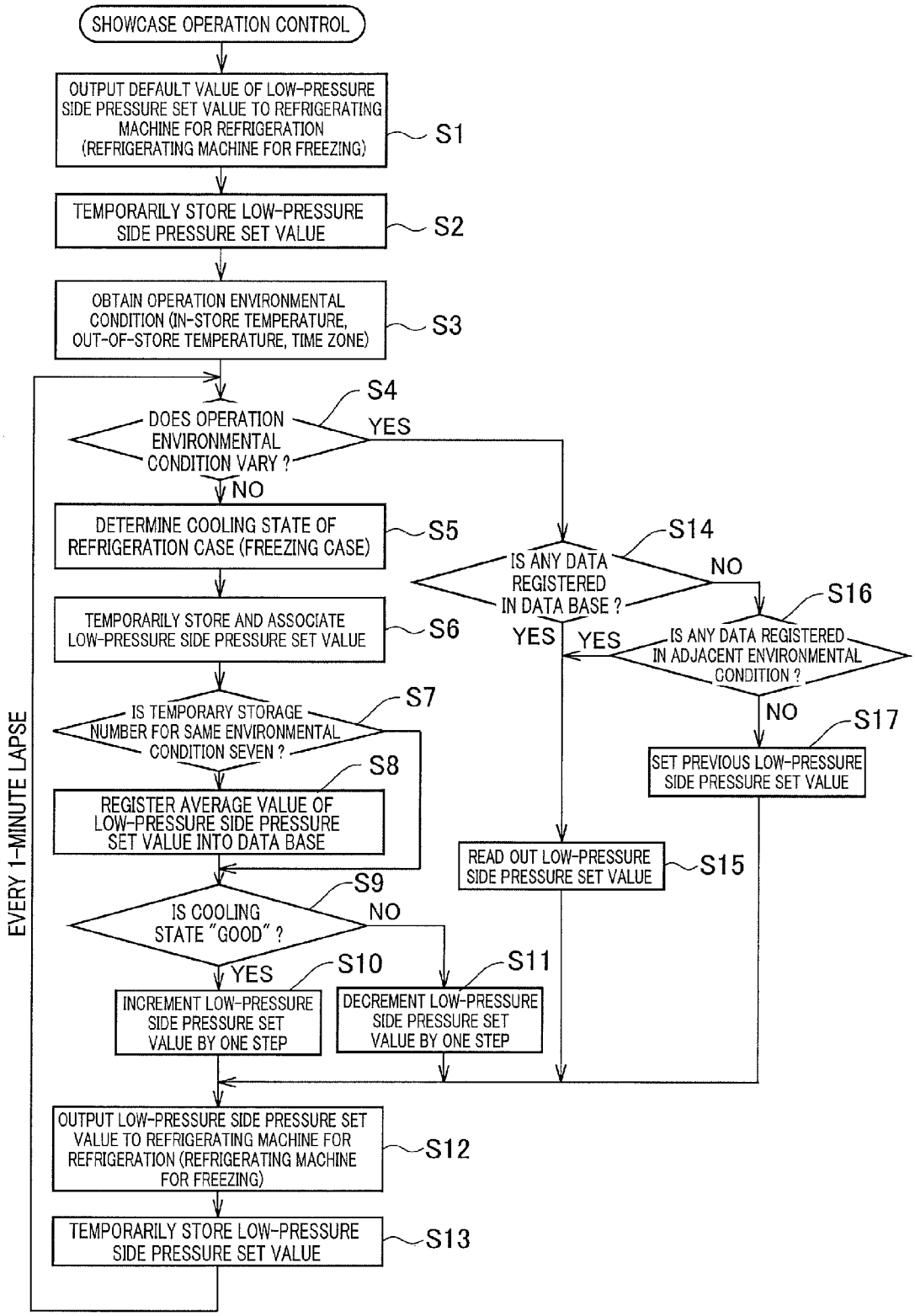
FIG. 5 is a flowchart showing the control operation of the controller.

FIG. 5 is a flowchart of the control operation of the controller 10.

First, a default value is pre-registered as an initial value of the low-pressure side pressure set value Ps as control data in all the registration places of the data base 15. Accordingly, at the initial stage that the refrigeration cases 1*a* and the refrigerating machine 11 for refrigeration are installed in a supermarket, the low-pressure side pressure set value Ps is set to the default value. This default value is set to a value for such an environment as summer season which requires highest cooling capacity, and in general, the power consumption is relatively high because there is an extra cooling capacity. The subsequent adjustment of the low-pressure side pressure set value Ps is optimized to be higher than the default value so that the power consumption is reduced, and thus the low-pressure side pressure set value Ps is not reduced to be lower than the default value through this adjustment.

At the initial stage of the installation of the showcases, the controller 10 reads out from the data base 15 the default value of the low-pressure side pressure set value Ps corresponding to the operation environmental condition comprising the three conditions of the in-store temperature Ti, the out-of-store temperature To and the time zone t, and outputs the read-out default value as the control data to the refrigerating machine 11 for refrigeration (step S1). Furthermore, in order to learn whether the low-pressure side pressure set value Ps output to the refrigerating machine 11 for refrigeration is right or not, the low-pressure side pressure set value Ps is temporarily stored together with the operation environmental condition (step S2). In the refrigerating machine 11 for refrigeration, the stop and start of the compressor are controlled on the basis of the low-pressure side pressure set value Ps transmitted from the controller 10. At this time, the low-pressure side pressure set value Ps is assumed as the value for the environment which needs the highest cooling capacity in the summer season, and thus the cooling capacity does not run short.

Thereafter, the controller 10 executes the processing such as the identification of the cooling state of the refrigeration cases 1*a*, the learning of the optimum value of the low-pressure side pressure set value Ps, the setting of the low-pressure side pressure set value Ps, etc. in accordance with the presence or absence of the variation of the operation environmental condition at a time interval of one minute, for example.

That is, the controller 10 obtains the operation environmental condition comprising the in-store temperature Ti, the out-of-store temperature To and the time zone t from the refrigeration cases 1*a*, the refrigerating machine 11 for refrigeration and the time counter 20 (step S3), and determines whether the operation environmental condition varies or not (step S4). As described above, the in-store temperature Ti and the out-of-store temperature To are made discrete every 5° C., and the time zone ti is made discrete every hour. When the variation width of any one of the in-store temperature Ti, the out-of-store temperature To and the time zone t exceeds the discrete range, it is determined that the operation environmental condition varies.

When there is no variation in the operation environmental condition (step S4: NO), the controller 10 identifies the cooling state on the basis of the differential temperature transmitted from each refrigeration case 1*a* in order to learn the optimum value of the low-pressure side pressure set value Ps to the operation environmental condition (step S5). Specifically, this is determined by determining whether the differential temperature is not less than a predetermined threshold value A for all the refrigerant cases 1*a*. When the differential temperatures of all the refrigeration cases 1*a* connected to the controller 10 are less than the predetermined threshold value A, the cooling state is determined as "good". When there is at least one refrigeration case 1*a* whose differential temperature is not less than the threshold value A, the cooling state is determined as "bad". This threshold value A is used to determine whether the differential temperature is good or not, and it is set to such a value that the inside of the storage room 39 of the refrigeration case 1*a* can be kept to a sufficiently excellent cooling state.

Subsequently, the controller 10 associates the good/bad determination result of the cooling state with the temporarily stored low-pressure side pressure set value Ps (step S6). The numbers of the low-pressure side pressure set values Ps and the number of the good/bad determination results of the cooling state reach a predetermined number (seven in this embodiment) (step S7: YES), the average value of the low-pressure side pressure set value Ps is registered into the operation environmental condition of the data base 15, thereby learning the optimum value (step S8). When the optimum value is learned as described above, any learning method may be adopted. For example, there may be adopted a method of adopting the average value of only low-pressure side pressure set values Ps with which the cooling state is determined as "good" or a method of weighting the low-pressure side pressure set values Ps in accordance with "good or bad" of the cooling state and then adopting the average value of the weighted low-pressure side pressure set values Ps.

Next, when the cooling state is determined as "good" (step S9: Yes), the controller 10 determines that the cooling capacity has an extra capacity to the operation environmental condition at the present time, and increases the low-pressure side pressure set value Ps by a fixed value (for example, 0.005 Mpa) (step S10), and outputs the newly set low-pressure side pressure set value Ps as the control data to the refrigerating machine 11 for refrigeration (step S12). In the refrigerating machine 11 for refrigeration, the stop and start of the compressor are controlled on the basis of the low-pressure side pressure set value Ps transmitted from the controller 10. At this time, since the low-pressure side pressure set value Ps is set to a higher value, and thus the low-pressure side pressure set value Ps for starting/stopping the compressor is also higher, so that the cooling capacity is lowered and also the power consumption is reduced. According to this control, when it is determined that there is an extra capacity in the cooling capacity of the cooling system RS, the cooling capacity of the refrigerating machine 11 for refrigeration is lowered to reduce the power consumption, and also the differential temperature of the storage room 39 of the refrigeration cases 1*a* is kept to be in the neighborhood of the threshold value A.

On the other hand, when the cooling state is "bad" (step S9: NO), the lower-voltage side pressure set value Ps is reduced by a fixed value (for example, 0.005 Mpa) (step S11), and outputs the thus-reduced low-pressure side pressure set value Ps as the control data to the refrigerating machine 11 for refrigeration (step S12). In the refrigerating machine 11 for refrigeration, the low-pressure side pressure set value Ps is set to a lower value, and thus the low-pressure side pressure set value Ps for starting/stopping the compressor is reduced, so that the cooling capacity is enhanced and the cooling state is improved to be good.

When outputting the low-pressure side pressure set value Ps as the control data to the refrigerating machine 11 for refrigeration, the controller 10 temporarily stores the low-pressure side pressure set value Ps in association with the operation environmental condition in order to learn this "good or bad" of the low-pressure side pressure set value Ps in step S8 (step S13).

Through the processing described above, the cooling system is operated year by year through transition from one season to the next, whereby low-pressure side pressure set values Ps having high power saving effects which are gradually obtained from actual measurements for the same operation environmental condition are successively registered in the data base 15.

On the other hand, when it is determined in step S4 that the operation environmental condition varies (step S4: YES), the controller 10 determines whether a low-pressure side pressure set value Ps proper to this operation environmental condition is registered in the data base 15 (step S14). When the low-pressure side pressure set value Ps is registered (step S14: Yes), the controller 10 reads out the low-pressure side pressure set value Ps concerned from the data base 15 (step S15), and it outputs the read-out low-pressure side pressure set value Ps concerned to the refrigerating machine 11 for refrigerant in step S12 and temporarily stores the pressure set value Ps concerned, thereby setting the optimum low-pressure side pressure set value Ps which has been already learned for the operation environmental condition and has a high energy saving effect.

Furthermore, when the low-pressure side pressure set value Ps is not registered in the data base 15 (step S14: NO), the controller 10 determines whether a learned low-pressure side pressure set value Ps is registered in an operation environmental condition Nc (see FIG. 4) adjacent to the current operation environmental condition (step S16). When it is registered (step S16: YES), the low-pressure side pressure set value Ps concerned is read out from the data base 15 (step S15), and performs the output of the data concerned to the refrigerating machine 11 for refrigeration in step S12 and the temporary storage of the data concerned in step S13.

More specifically, the default value of the low-pressure side pressure set value Ps is registered in the unlearned operation environmental condition in advance as described above. This default value is set to the value for the environment which requires the highest cooling capacity in the summer season, and thus the power saving effect cannot be expected. Accordingly, when this default value is adopted in the unlearned state, an operation under which the power saving cannot be obtained is continued until the learning is completed. The learning requires samples of plural low-pressure side pressure set values Ps under the same operation environmental condition. Accordingly, it requires a long time until the learning is completed in an environment under which the temperature variation of the in-store temperature or the out-of-store temperature is severe.

On the other hand, under a so-called adjacent operation environmental condition that is different from some operation environmental condition in only one parameter of the in-store temperature Ti, the out-of-store temperature To and the time zone t by the amount corresponding to only one discrete point, the respective optimum low-pressure side pressure set values Ps for both the operation environmental conditions are not so extremely different from each other because these operation environmental conditions are near to each other. Accordingly, when the low-pressure side pressure set value Ps for some operation environmental condition are unlearned, by setting the learned low-pressure side pressure set value Ps for the operation environmental condition Nc adjacent to the above operation environmental condition, the energy saving effect can be expected, and also the learning completion (convergence) to the optimum value can be made early.

Here, in this embodiment, as described above, the three conditions of the time zone t, the in-store temperature Ti and the out-of-store temperature To are adopted as the operation environmental condition. Here, only an operation environmental condition whose in-door temperature Ti or out-of-store temperature is adjacent to that of the operation environmental condition being noted is set as the adjacent operation environmental condition Nc, and an operation environmental condition whose time zone t is different from that of the operation environmental condition is not adopted as the adjacent operation environmental condition Nc. That is, the variation of the cooling state with respect to the time zone t is sure, and the cooling state in each time zone is fixed, but unique, so that it is not sure that the cooling states in the adjacent time zones t are seamlessly varied. The best example is a time zone bridging a store open time and a store close time. In this time zone, for example, when the store open time is 10 o'clock, the cooling state greatly varies between the time zones before and after the store is opened.

On the other hand, with respect to the in-store temperature Ti and the out-of-store temperature To, it may be theoretically considered that the different cooling states between the adjacent operation environmental conditions are seamlessly shifted to each other. However, in this embodiment, when the low-pressure side pressure set value Ps of the adjacent operation environmental condition Nc is adopted, the refrigerating machine 11 for refrigeration is greatly affected by the out-of-store temperature To, and also the cooling state of the refrigeration case 1*a* is also greatly affected by the out-of-store temperature To, so that the operation environmental condition whose out-of-store temperature To is adjacent is adopted preferentially to the operation environmental condition whose in-store temperature To is adjacent.

Returning to FIG. 5, when no learned low-pressure side pressure set value Ps is registered in the operation environmental condition Nc adjacent to the present operation environmental condition (step S16: NO), it is regarded that each of the in-store temperature Ti and the out-of-store temperature To is not greatly varied for about one minute, and thus the controller 10 sets the just-before low-pressure side pressure set value Ps (step S17), and performs the output and temporary storage of this data to the refrigerating machine 11 for refrigeration in steps S12, S13.

As described above, according to this embodiment, in a case where (the optimum value of) the low-pressure side pressure set value Ps corresponding to an operation environmental condition to be generated is not registered in the data base 15, when the low-pressure side pressure set value Ps corresponding to an operation environmental condition Nc adjacent to the operation environmental condition to be generated is registered in the data base 15, the low-pressure side pressure set value Ps concerned is used. Therefore, as compared with the case where the default value of the low-pressure side pressure set value Ps is used, the operation can be executed at the low-pressure side pressure set value Ps nearer to the optimum value, and thus the energy saving effect can be enhanced with keeping the cooling state "good".

According to this embodiment, by using the in-store temperature Ti, the out-of-store temperature To and the time zone t as the operation environmental condition, the cooling system of this embodiment can be surely adapted to not only the change of the season, the store open/close state, the turn-on/out of illumination, the working situation such as supplement of goods, setup of a night cover or the like, customer coming situation, etc.

At this time, the operation environmental condition whose in-store temperature Ti or out-of-store temperature To is adjacent is used as the adjacent operation environmental condition Nc, and the time zone t is not used for the adjacent operation environmental condition Nc. Therefore, the situation that the cooling state is greatly varied in accordance with the store open state or store close state can be prevented, whereby the cooling state can be seamlessly varied.

According to this embodiment, when the low-pressure side pressure set value Ps is registered in each of an operation environmental condition Nc whose in-store temperature Ti is adjacent and an operation environmental condition Nc whose out-of-store temperature To is adjacent, the low-pressure side pressure set value Ps for the operation environmental condition Nc whose out-of-store temperature To is adjacent is preferentially used. Therefore, the cooling state can be more seamlessly varied.

The present invention is not limited to the above embodiment, and various modifications and applications may be freely made without departing from the subject matter of the present invention.

For example, the operation environmental conditions described in the above embodiment does not limit the present invention. Furthermore, in this embodiment, the low-pressure side pressure set value of the refrigerating machine is adjusted as the control data. However, the present invention is not limited to this style, and any control factor may be targeted insofar as it relates to the cooling capacity and power consumption of the cooling system. Furthermore, in the above embodiment, the low-pressure side pressure set value is adjusted at a period of one minute, however, the adjustment time interval is not limited to one minute, but it may be changed in accordance with a use condition such as a time interval (period) of 10 minutes, 30 minutes, one hour, one hour and a half, two hours or the like.

What is claimed is:

1. A controller for a cooling system comprising a low-temperature showcase having a storage room and a refrigerating machine for supplying refrigerant to the low-temperature showcase, comprising:

a control data generating unit for generating control data for controlling an operation of the refrigerating machine under an operation environmental condition for defining an operation environment of the cooling system; and a data base constructing unit for registering an optimum value of the control data based on a determination result concerning a cooling state of the storage room of the low-temperature showcase which occurs through the operation based on the control data while associating the optimum value with the operation environmental condition, thereby constructing a data base, wherein when an optimum value of the control data corresponding to an operation environmental condition to be generated is registered in the data base, the control data generating unit uses the optimum value of the control data, and when an optimum value of the control data corresponding to an operation environmental condition to be generated is not registered in the data base, the control data generating unit uses an optimum value of the control data registered in association with an operation environmental condition adjacent to the operation environmental condition to be generated, wherein the operation environmental condition adjacent to the operation environmental condition to be generated is an operation environmental condition that is stored in the database and that differs from the operation environmental condition to be generated by a predetermined discrete amount.

2. The controller for the cooling system according to claim 1, wherein the operation environmental condition contains at least in-store temperature, out-of-store temperature and time, and the control data generating unit uses, as the adjacent operation environmental condition, an operation environmental condition whose in-store temperature or out-of-store temperature is adjacent to that of the operation environmental condition to be generated.

3. The controller for the cooling system according to claim 2, wherein when optimum values of the control data are respectively registered in an operation environmental condition whose in-store temperature is adjacent and an operation environmental condition whose out-of-store temperature is adjacent, the control data generating unit uses the optimum value of the control data for the operation environmental condition whose out-of-store temperature is adjacent.

4. The controller for cooling system according to claim 1, wherein the optimum value of the control data corresponding to the operation environmental condition to be generated is not registered in the data base and the optimum value of the control data corresponding to the operation environmental condition adjacent to the operation environmental condition to be generated is not registered in the data base, the control data generating unit uses control data which is used just before the refrigerating machine is operated.

5. The controller for the cooling system according to claim 1, wherein the control data generating unit generates the control data so as to reduce power consumption of the refrigerating machine with keeping the storage room of the low-temperature showcase cooled on the basis of the cooling state and the operation environmental condition.

* * * * *